US007146890B1

(12) United States Patent
Rowe

(10) Patent No.: US 7,146,890 B1
(45) Date of Patent: Dec. 12, 2006

(54) ANNULAR OCTAGONAL HAND HELD PUSHING TOOL FOR USE WITH CUTTING AND ABRASIVE TOOLS

(76) Inventor: Dennis Rowe, 8811 Canoga Ave., Space 387, Canoga Park, CA (US) 91304

( * ) Notice: Subject to any disclaimer, the term of this patent is extended or adjusted under 35 U.S.C. 154(b) by 0 days.

(21) Appl. No.: 11/128,756

(22) Filed: May 13, 2005

(51) Int. Cl.
*B27B 25/10* (2006.01)

(52) U.S. Cl. ..... 83/13; 83/436.2; 83/437.2

(58) Field of Classification Search ..... 83/425, 83/437.2, 438, 436.2, 13; D99/99; D8/14; 30/346.57; 446/103, 266
See application file for complete search history.

(56) References Cited

U.S. PATENT DOCUMENTS

| | | | | |
|---|---|---|---|---|
| 700,617 | A | | 5/1902 | Cobaugh |
| 2,410,467 | A | | 11/1946 | Valentine |
| 2,696,852 | A | | 12/1954 | Dunton |
| 2,771,920 | A | | 11/1956 | Ambelang |
| 2,839,100 | A | | 6/1958 | Valicenti |
| D186,935 | S | | 12/1959 | Littlefield |
| 4,001,903 | A | | 1/1977 | Hay |
| 4,026,173 | A | | 5/1977 | Livick |
| 4,348,925 | A | | 9/1982 | Manweiler |
| 4,370,909 | A | | 2/1983 | Jennings |
| 4,399,728 | A | | 8/1983 | Davis |
| 4,485,711 | A | | 12/1984 | Schnell |
| D278,022 | S | | 3/1985 | Ash |
| 4,603,612 | A | | 8/1986 | Atkins |
| 4,730,596 | A | * | 3/1988 | Maack et al. ..... 125/11.03 |
| 4,767,277 | A | * | 8/1988 | Buse ..... 416/241 A |
| 5,016,509 | A | | 5/1991 | Stottman |
| D329,576 | S | * | 9/1992 | Desjardin ..... D8/14 |
| 5,194,031 | A | * | 3/1993 | Sahler ..... 446/103 |
| 5,293,800 | A | | 3/1994 | Nunn, Jr. |
| 5,341,711 | A | | 8/1994 | Stay, Jr. et al. |
| 5,415,067 | A | | 5/1995 | Neilson |
| 5,678,467 | A | | 10/1997 | Aigner |
| 5,692,425 | A | | 12/1997 | Sterling |
| 5,875,827 | A | | 3/1999 | Brutscher et al. |
| 5,894,777 | A | | 4/1999 | Sterling |
| 6,044,740 | A | | 4/2000 | Werkheiser |
| 6,135,521 | A | | 10/2000 | Wirth, Jr. et al. |
| 6,561,866 | B1 | * | 5/2003 | Lee ..... 446/90 |
| 6,732,623 | B1 | | 5/2004 | Jennings |

* cited by examiner

*Primary Examiner*—Charles Goodman
(74) *Attorney, Agent, or Firm*—Daniel R. Richardson

(57) ABSTRACT

A hand held pushing tool for use with cutting and abrasive tools is formed as a planar disk. The disk has a first side surface, a second side surface, a first predetermined thickness and an outer peripheral edge. The outer peripheral edge has at least one notch. The notch extends from the first side surface to the second side surface and is located orthogonally to the outer peripheral edge. The notch has a depth less than a thickness of a work piece. When the notch engages the work piece, the pushing tool will safely guide the work piece into and through the cutting or abrasive tool. The pushing tool is shaped as an octagon having a plurality of varying size notches about its outer peripheral edge. The tool may be inverted to use the notch to hook the work piece and draw it back past the cutting or abrasive tool.

6 Claims, 3 Drawing Sheets

ANNULAR OCTAGONAL HAND HELD PUSHING TOOL FOR USE WITH CUTTING AND ABRASIVE TOOLS

FIELD OF INVENTION

The invention pertains to devices for use with dangerous power tools such as circular and band saws, sanders, shapers and grinders. More particularly, the invention relates to means for controllably feeding material of varying thicknesses into such tools while providing a margin of safety for the hands of the operator.

BACKGROUND OF THE INVENTION

Woodworking often involves cutting or shaping pieces of wood in close proximity to high-speed saw blades, cutters or moving abrasives. These devices present a substantial risk to the hands and fingers of the tool operator, particularly when the work piece is small or the piece to be removed is small or thin. To reduce the risk of working so close to such dangerous machinery, a variety of pushing and guiding systems have been developed for use with cutting and abrasive tools.

U.S. Pat. No. 6,591,724, issued to Huang, discloses an improved structure for saw clip. On the working deck, there is a lead trough. On the pivot of this working deck, there is a block section for items to wait to be sawed. A top pusher block, when moved onwards, can be used to fix the items so that the sawing process can go smoothly. Among the parts of this invention, there is a sliding trough on top of the block and the sliding trough and the lead trough go across each other. Moreover, a lead screw goes through both the sliding trough and lead trough. The lead screw can be adjusted to be at any position in the lead trough to change how the block is placed. Then, the block can be screwed tightly so that it will not turn upon receiving the pushing force from clipping.

U.S. Pat. No. 6,578,461, issued to Loo, describes a combination rip fence and work piece pusher that is provided for a table saw or shaper. A preferred work piece pusher moves along a track having a central portion aligned with the feed direction and having two end portions skewed with respect to the feed direction so that the work piece pusher retracts into the rip fence at both limits of its travel. This allows a sawyer to retract the work piece pusher on the infeed side of a table saw and begin a ripping operation in which he or she manually pushes the work piece into the saw blade until the trailing end of the work piece is close enough to the saw blade that the work piece pusher can be moved out of the fence to engage the trailing end of the stock. The pusher can then be used to push the work piece the rest of the way past the blade. This apparatus also allows a woodworker to operate a table-mounted cutting tool without using a work piece pusher of the invention that is installed on that table. In this mode of operation, if the work piece pusher is incidentally engaged by the work piece, the work piece pusher does not jam the work piece into the tool or into the rip fence, but is merely pushed to the outfeed side of the table where it retracts within the rip fence.

U.S. Pat. No. 6,732,623, issued to Jennings, illustrates a safety push tool for use with table mounted cutting tools. The push tool is of the type having a carrier guide body with an underside adapted to rest on a work piece to be moved along a cutting tool. The safety push tool has a handle portion and the improvement of the present invention is the construction of the back heel member which is held at the slot of the back of the tool. The back heel member is a U-shaped device which fits over a slot over the back of the tool. The back heel member is a U-shaped device which fits over a support arm and can be rotated from a first position where two separate arms depend downwardly from the underside. It also can be moved in a second position where a cross member headstock extends below the underside of the safety push tool.

U.S. Pat. No. 5,894,777, issued to Sterling, discloses a protective push stick that includes a transparent cover extending over the cutting tool of a machine tool to protect the operator's hand from the saw blade, to protect the operator's eye from particles flying upwards from the cutting tool and still provide some visibility of the cutting tool to the operator.

U.S. Pat. No. 5,678,467, issued to Aigner, describes an exchangeable handle for wooden pushers which handle includes a grip having a base plate which is L-shaped in cross section, this base plate having a long leg and a short leg in which spikes are provided for driving into the wooden pusher. The spikes attached to the short leg project at right angles from the short leg and extend parallel to the long leg. The spikes provided at the free end of the long leg are attached to a swivel lever which is rotatable about a shaft. The spikes which project out of the long leg through openings therein can be swiveled by an actuating lever from a direction substantially parallel to the sort leg into an engagement position at an angle thereto.

U.S. Pat. No. 6,135,521, issued to Wirth, Jr., et al., shows a push stick for use with woodworking equipment is provided with a main body having two stepped portions or notches for positive engagement with a work piece. The push stick has an ergonomically designed, open grip handle and non-slip pads on working surfaces for control and ease of use.

U.S. Pat. No. 5,148,846, issued to Van Gelder, describes a work piece guide to help feed boards into a woodworking machine such as a power saw. The guide is adapted to hold the board against the guide fence as the board is fed into the saw by pressing a knurled wheel down against the board. The wheel is slightly angled to move the board toward the fence and is pressed down against the board by a leaf spring thus keeping the board from riding up on the blade.

U.S. Pat. No. 6,044,740, issued to Werkheiser, discloses a push stick for use with stationary power tools including table saws and shapers. The push stick has a flat base plate that can ride on the surface of the power tool thereby providing stable operation with a resulting increase in safety for the operator and more accurate cutting. A handle of the push stick is placed at an optimum angle to provide both downward and forward pressure on a work piece. The push stick may also be equipped with a variable handle angle to optimize its use with different power tools. The base plate of the push stick may be adjustable in thickness to accommodate work pieces of different thicknesses.

U.S. Pat. No. 5,016,509, issued to Stottman, describes a combination safety guide and measuring tool providing a safe, reliable means for advancing wood over or through table mounted wood working equipment, and in addition, providing a measuring tool for many important wood working problems. Among the unique features provided by this device are a conventional push tool, a means for measuring the distance of the cutting tool from the wood piece, and a means for accurately measuring the height of the cutting instrument. Because of the unique design of this invention, the worker can perform many measuring functions without the necessity of several measuring tools and, in addition, have a safe, reliable push stick for moving the wood piece through the wood working equipment.

It is an objective of the present invention to provide a pushing device to guide and position work pieces of varying thickness into cutting or abrasive power tools in a manner that is safe and accurate. It is a further objective to provide a pushing device that can be easily grasped and controlled by one hand. It is a still further objective of the invention to provide a pushing device that can be easily used in both vertical and horizontal planes. It is yet a further objective to provide a pushing device that can be easily, inexpensively and accurately manufactured. Finally, it is an objective of the invention to provide a pushing device that can easily be used with either hand.

While some of the objectives of the present invention are disclosed in the prior art, none of the inventions found include all of the requirements identified.

SUMMARY OF THE INVENTION

The present invention addresses all of the deficiencies of prior art hand held pushing tool inventions and satisfies all of the objectives described above.

(1) A hand held pushing tool for use with cutting and abrasive tools can be constructed as follows. A planar disk is provided. The disk has a first side surface, a second side surface, a first predetermined thickness and an outer peripheral edge. The outer peripheral edge has at least one notch. The notch extends from the first side surface to the second side surface and is disposed orthogonally to the outer peripheral edge. The notch has a depth less than a thickness of a work piece. When the notch engages the work piece, the pushing tool will safely guide the work piece into and through the cutting or abrasive tool.

(2) In a variant of the invention, the outer peripheral edge is substantially octagonal in shape.

(3) In another variant, the outer peripheral edge comprises a plurality of notches. Each of the notches is sized and shaped to engage a work piece of a thickness greater than the depth of the notch.

(4) In still another variant, the planar disk is in the form of a planar ring and further comprises at least one finger grip. The finger grip is located along an inner peripheral edge of the ring.

(5) In a final variant of the invention, the planar ring includes a reduced thickness between the finger grip and an inner portion of the outer peripheral edge.

(6) A method of using a hand held pushing tool for use with cutting and abrasive tools, includes providing a planar disk. The disk has a first side surface, a second side surface, a first predetermined thickness and an outer peripheral edge. The outer peripheral edge has at least one notch, the notch extending from the first side surface to the second side surface and is located orthogonally to the outer peripheral edge. The notch has a depth less than a thickness of a work piece. Engaging the work piece by placing the notch over a rear edge of the work piece. Moving the pushing tool and the work piece into and through the cutting or abrasive tool. Inverting the pushing tool so that one of the notches functions as a hook. Hooking the inverted notch over a front edge of the work piece. Retracting the inverted pushing tool to draw the work piece back past the cutting or abrasive tool.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1–5 illustrate a hand held pushing tool for use with cutting and abrasive tools 10 that can be constructed as follows. A planar disk 14 is provided. The disk 14 has a first side surface 18, a second side surface 22, a first predetermined thickness 26 and an outer peripheral edge 30. The outer peripheral edge 30 has at least one notch 34. The notch 34 extends from the first side surface 18 to the second side surface 22 and is disposed orthogonally to the outer peripheral edge 30. The notch 34 has a depth 38 less than a thickness 42 of a work piece 46. When the notch 34 engages the work piece 46, the pushing tool 10 will safely guide the work piece 46 into and through the cutting or abrasive tool 74.

Figure 1:
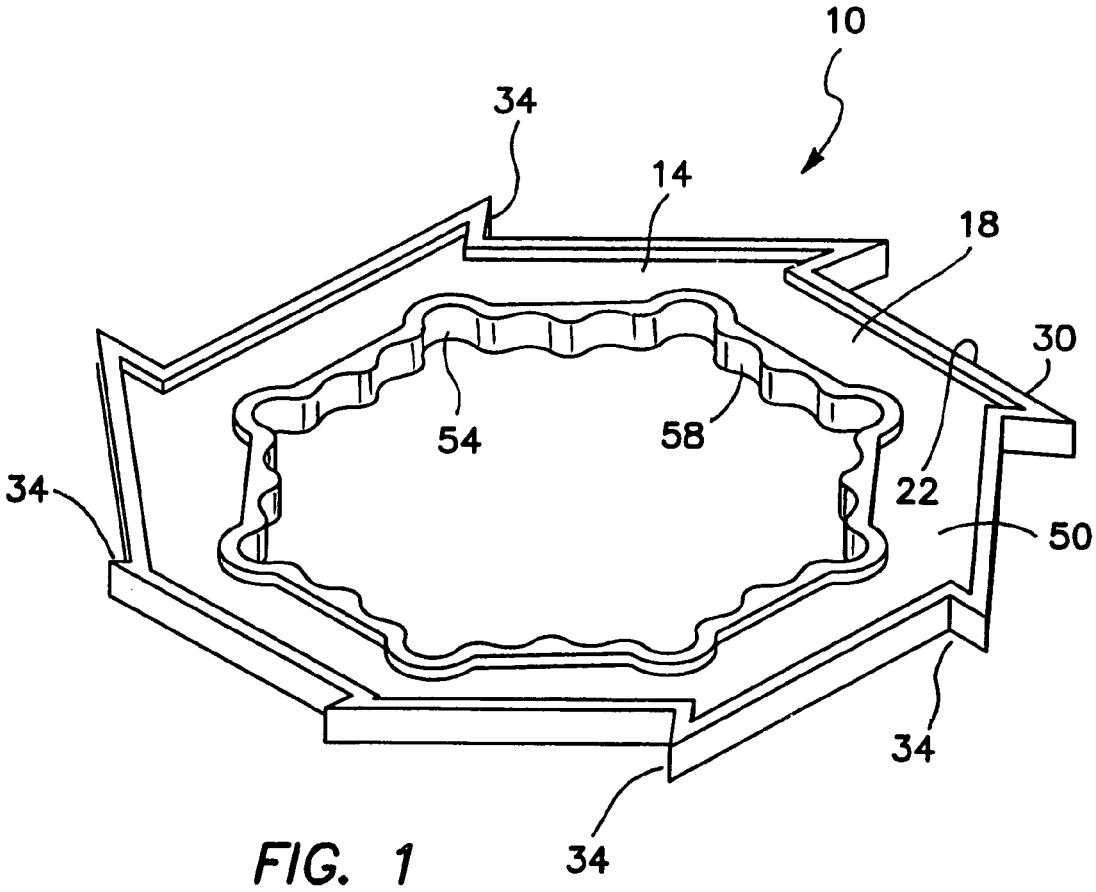
FIG. 1 is a perspective view of the preferred embodiment of the invention illustrating pushing notches of varying depths and a central opening with finger notches.
Figure 2:
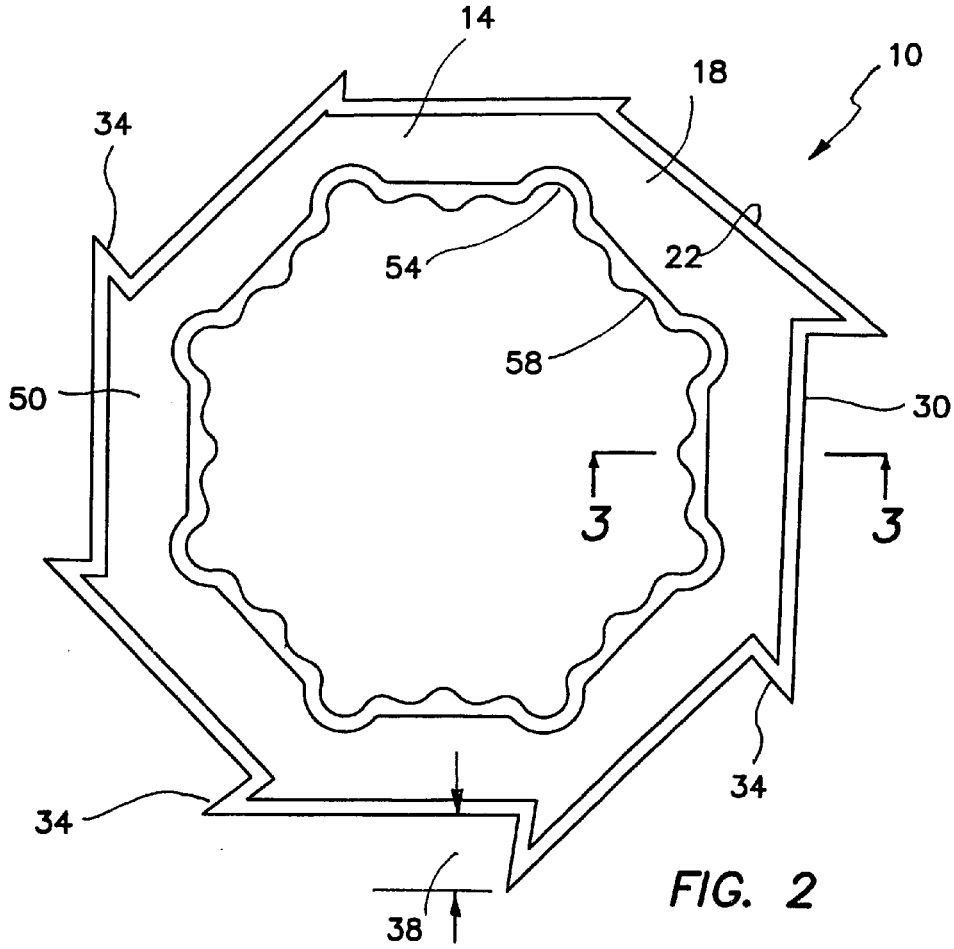
FIG. 2 is a side elevational view of the FIG. 1 embodiment.

(2) In a variant of the invention, the outer peripheral edge 30 is substantially octagonal in shape.

(3) In another variant, the outer peripheral edge 30 comprises a plurality of notches 34. Each of the notches 34 is sized and shaped to engage a work piece 46 of a thickness 42 greater than the depth 38 of the notch 34.

(4) In still another variant, the planar disk 14 is in the form of a planar ring 50 and further comprises at least one finger grip 54. The finger grip 54 is located along an inner peripheral edge 58 of the ring 50.

Figure 3:
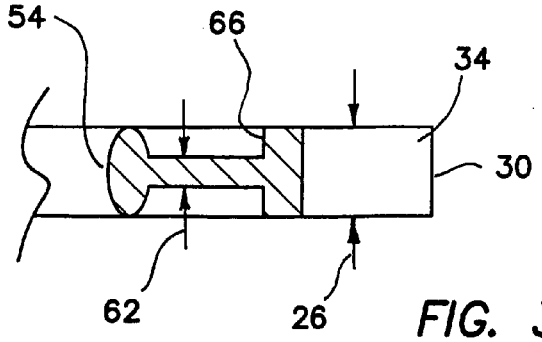
FIG. 3 is a cross-sectional view of the FIG. 1 embodiment taken along the line 3—3 illustrating the finger notch.

(5) In a final variant of the invention, as best illustrated in FIG. 3, the planar ring 50 includes a reduced thickness 62 between the finger grip 54 and an inner portion 66 of the outer peripheral edge 30.

Figure 4:
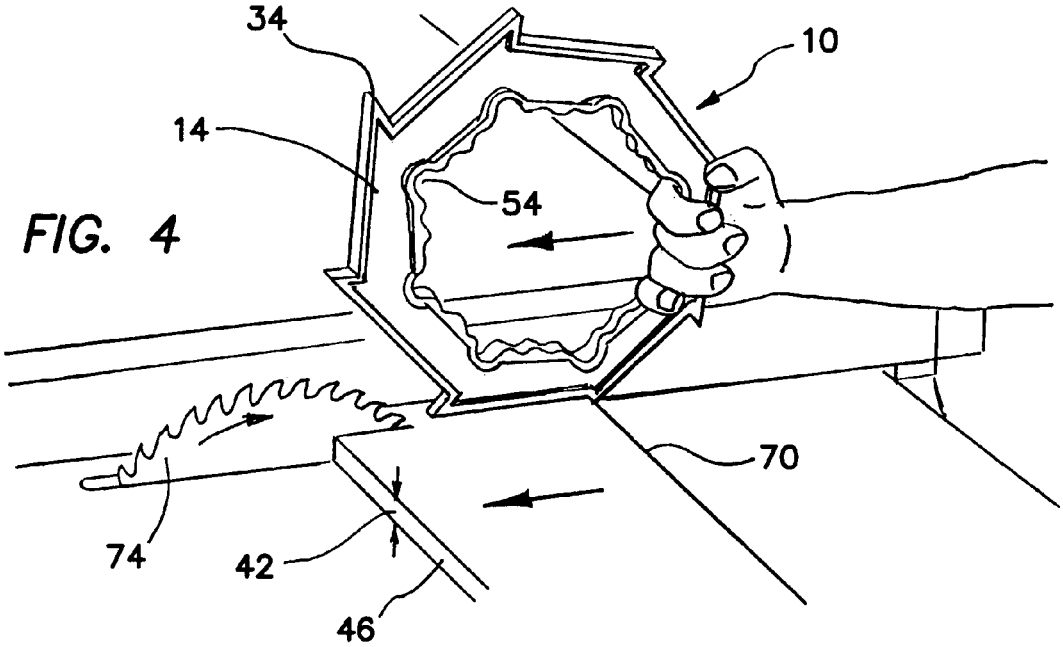
FIG. 4 is a perspective view of the FIG. 1 embodiment pushing a work piece through a cutting tool.
Figure 5:
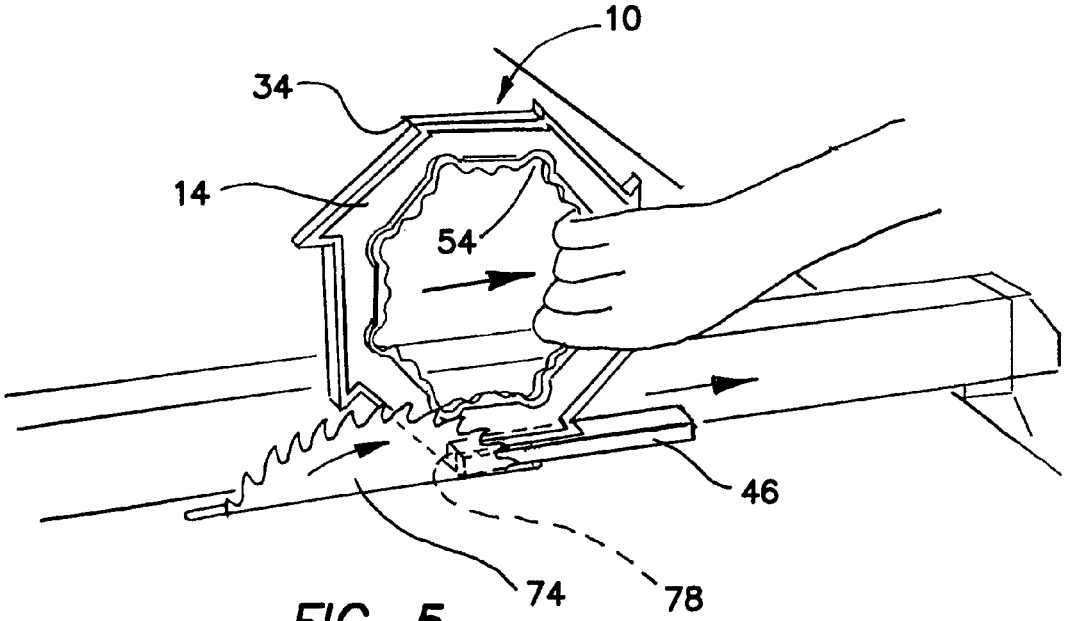
FIG. 5 is a perspective view of the FIG. 1 embodiment inverted and pulling a work piece back past a cutting tool.

(6) A method of using a hand held pushing tool for use with cutting and abrasive tools 10, includes providing a planar disk 14, as illustrated in FIGS. 4 and 5. The disk 14 has a first side surface 18, a second side surface 22, a first predetermined thickness 26 and an outer peripheral edge 30. The outer peripheral edge 30 has at least one notch 34, the notch 34 extending from the first side surface 18 to the second side surface 22 and is located orthogonally to the outer peripheral edge 30. The notch 34 has a depth 38 less than a thickness 42 of a work piece 46. Engaging the work piece 46 by placing the notch 34 over a rear edge 70 of the work piece 46. Moving the pushing tool 10 and the work piece 46 into and through the cutting or abrasive tool 74. Inverting the pushing tool 10 so that one of the notches 34 functions as a hook. Hooking the inverted notch 34 over a front edge 70 of the work piece 46. Retracting the inverted pushing tool 10 to draw the work piece 46 back past the cutting or abrasive tool 74.

The annular octagonal hand held pushing tool for use with cutting and abrasive tools 10 has been described with reference to particular embodiments. Other modifications and enhancements can be made without departing from the spirit and scope of the claims that follow.

The invention claimed is:

1. A method of using a hand held pushing tool for use with cutting and abrasive tools, comprising:

An annular octagonal hand held pushing tool for use with cutting and abrasive tools, comprising:

a planar ring, said ring having a first side surface, a second side surface, a first predetermined thickness, an outer peripheral edge, an inner edge, and a center opening;

said center opening being bounded by said inner edge and sufficiently large to accommodate all four fingers of the human operator;

said inner edge having such depth as to extend both above and below said planar ring's first predetermined thickness, and having finger grips disposed equally around said inner edge;

said finger grips being formed into sets of grooves each set of grooves being designed to comfortably accommodate all four fingers of the human operator's hand, with the grooves for the first and fourth fingers being further inset than the grooves for the second and third fingers so as to provide a firm comfortable grip;

said outer peripheral edge having such depth as to extend both above and below said planar ring's first predetermined thickness, and being formed into a multiplicity of notches extended generally outward and perpendicular from the center of said planar ring and having a flat surface between notches;

said notch in the outer peripheral edge having a depth from the outer tip of the notch to the base of said flat surface between said notches of less than the thickness of a work piece;

engaging said work piece by placing said flat surfaces between said notches over the rear edge of said work piece;

moving said pushing tool and said work piece into and through said cutting or abrasive tool;

inverting said pushing tool so that one of said notches functions as a hook;

hooking said inverted notch over a front edge of said work piece; and retracting said inverted pushing tool to draw said work piece back past said cutting or abrasive tool.

2. An annular octagonal hand held pushing tool for use with cutting and abrasive tools, comprising:

a planar ring, said ring having a first side surface, a second side surface, a first predetermined thickness, an outer peripheral edge, an inner edge, and a center opening;

said center opening being bounded by said inner edge and sufficiently large to accommodate all four fingers of the human operator;

said inner edge having such depth as to extend both above and below said planar ring's first predetermined thickness, and having finger grips disposed equally around said inner edge;

said finger grips being formed into sets of grooves each set of grooves being designed to comfortably accommodate all four fingers of the human operator's hand, with the grooves for the first and fourth fingers being further inset than the grooves for the second and third fingers so as to provide a firm comfortable grip;

said outer peripheral edge having such depth as to extend both above and below said planar ring's first predetermined thickness, and being formed into a multiplicity of notches extended generally outward and perpendicular from the center of said planar ring and having a flat surface between notches;

said notch in the outer peripheral edge having a depth from the outer tip of the notch to the base of said flat surface between said notches of less than the thickness of a work piece; and whereby, when said notch engages said work piece, said annular octagonal hand held pushing tool will safety guide said work piece into and through said cutting or abrasive tool within the firm and comfortable grip of the human operator.

3. The annular octagonal hand held pushing tool for use with cutting and abrasive tools, as described in claim 2, wherein said outer peripheral edge is substantially octagonal in shape.

4. The annular octagonal hand held pushing tool for use with cutting and abrasive tools, as described in claim 2, wherein said flat surfaces between notches in said outer peripheral edge provide a flat surface for the human operator to place the palm of their hand so as to use said finger grips.

5. The annular octagonal hand held pushing tool for use with cutting and abrasive tools, as described in claim 2, wherein said inner edge is comprised of four of said finger grips.

6. The annular octagonal hand held pushing tool for use with cutting and abrasive tools, as described in claim 2, wherein one of said notches in said outer peripheral edge is of different depth than the other said notches.

* * * * *